United States Patent [19]

Bower

[11] 4,049,120

[45] Sept. 20, 1977

[54] TAPE REEL SHIPPING FOLDER

[75] Inventor: Thomas E. Bower, Long Beach, Calif.

[73] Assignee: Owens-Illinois, Inc., Toledo, Ohio

[21] Appl. No.: 671,890

[22] Filed: Mar. 29, 1976

[51] Int. Cl.[2] ..... B65D 85/67

[52] U.S. Cl. ..... 206/396; 206/303; 206/491; 206/493

[58] Field of Search ..... 206/396, 392, 389, 395, 206/408, 491, 493, 310, 303

[56] References Cited

U.S. PATENT DOCUMENTS

| | | | |
|---|---|---|---|
| 2,646,202 | 7/1953 | Gibbons | 206/392 |
| 2,875,892 | 3/1959 | Brewer | 206/392 |
| 3,401,792 | 9/1968 | Tolaas | 206/396 |

*Primary Examiner*—William T. Dixson, Jr.
*Attorney, Agent, or Firm*—A. J. Steger; E. J. Holler

[57] ABSTRACT

A folder for packaging and shipping a reel of magnetic or recording tape which supports the reel of tape on both sides and prevents slipping of the tape. The folder includes a pair of hinged panels which are foldable into overlying relationship with the opposite sides of the reel of tape. At least one of the panels includes unique hub-locking tabs which fold to fit within the center opening of the reel hub to securely position the reel of tape. The areas adjacent to the hub-locking tabs are crushed to a reduced thickness to accommodate the width of the reel hub to allow the hinged panels to rest flush against the edges of the tape on the reel. The hinged panels also include mating corner-locking tabs and cutouts which cooperate to lock the panels together to form the folder.

2 Claims, 10 Drawing Figures

46

TAPE REEL SHIPPING FOLDER

BACKGROUND OF THE INVENTION

This invention relates to packaging of reel-type products and, more particularly, it relates to a unique folder for packaging a reel of magnetic or recording tape. Magnetic or recording tape is generally wound onto an annular reel about an annular center hub, which usually has a greater thickness than the tape. The generally used method of shipping such reels of tape has involved a plastic tray which holds the reel rather loosely and does not support the tape on both sides, thereby allowing the tape to shift. If the tape is allowed to shift or slip, it is difficult to fit the reel on a playback machine, and the quality of the recording is frequently impaired. It is, therefore, an object of this invention to provide a unique package for shipping reels of magnetic tape which eliminates the disadvantages associated with the previously used shipping packages. The package of this invention provides a unique folder which closes into tight contact with the reel of tape on both sides, to thereby securely position the reel and prevent slipping of the tape. The folder includes a pair of hinged panels which are foldable into overlying relationship with the opposite sides of the reel of tape. At least one of the panels includes unique hub-locking tabs which fold to fit within the center opening of the reel hub to rigidly position the reel of tape. The areas adjacent to the hub-locking tabs are crushed to a reduced thickness to accommodate the width of the reel hub of the reel to thereby allow the hinged panels to rest flush against the sides of the tape which is wound on the reel. The hinged panels also include mating corner-locking tabs and cutouts to lock the panels together to form the folder.

Other objects, features and advantages of the subject invention will become apparent to one skilled in the art upon reference to the following detailed description and the drawings illustrating the preferred embodiment of the invention.

IN THE DRAWINGS

DETAILED DESCRIPTION OF THE PREFERRED EMBODIMENTS

Figure 2:
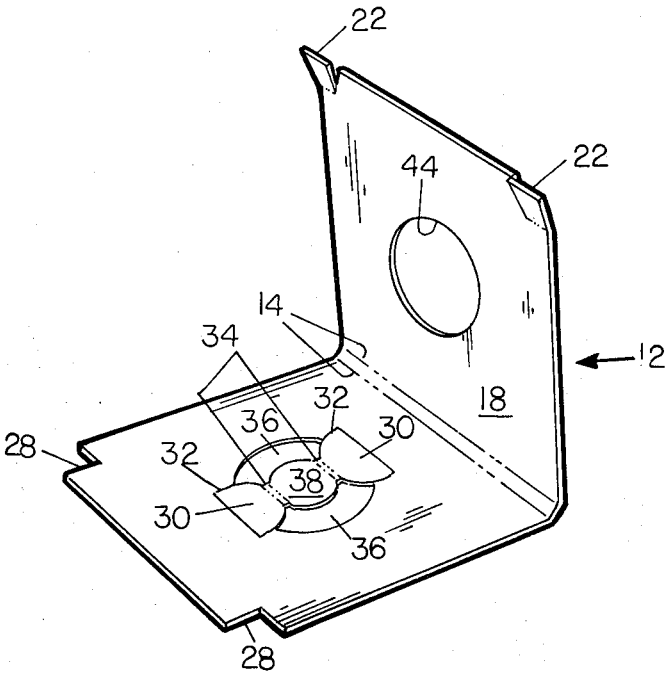
FIG. 2 is a perspective view of the paperboard sheet of FIG. 1 folded to a position where it is adapted to receive a reel of tape.
Figure 1:
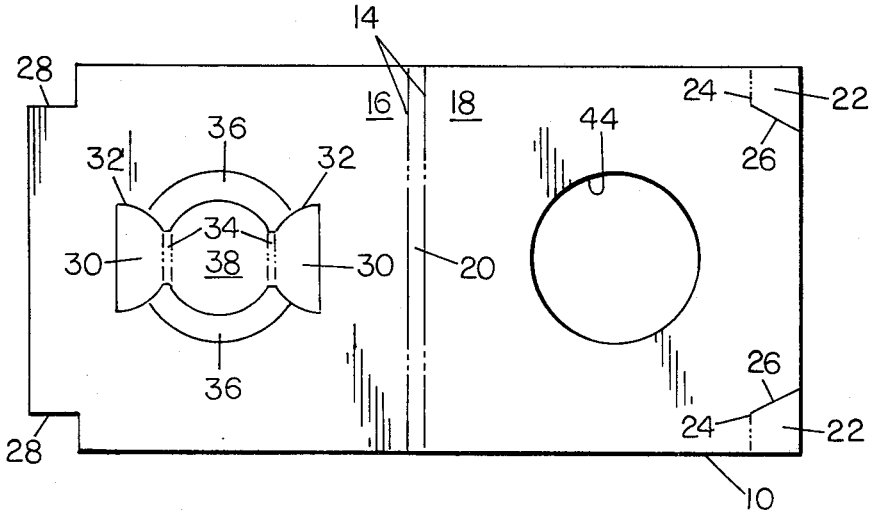
FIG. 1 is a top plan view of a sheet of corrugated paperboard which has been slit and scored so as to be adapted to form one embodiment of the unique folder package of this invention.

Referring now to the drawings, the numeral 10 refers to a sheet of corrugated paperboard which has been slit and scored and is adapted to be folded to form the folder indicated generally by the numeral 12 in FIG. 2. Sheet 10 incorporates a pair of score lines 14 which divide the sheet into a pair of folder panels 16 and 18 which are hingedly attached to one another by means of a hinge panel 20 formed between the score lines 14.

Figure 3:
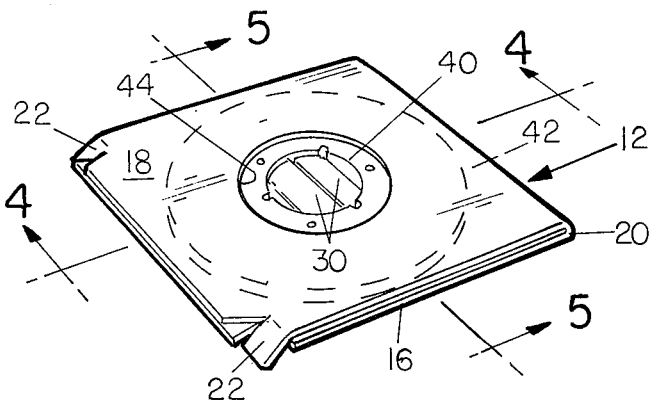
FIG. 3 is a perspective view of the folder of FIG. 2 after it has been folded to a closed position around a reel of tape.
Figure 4:
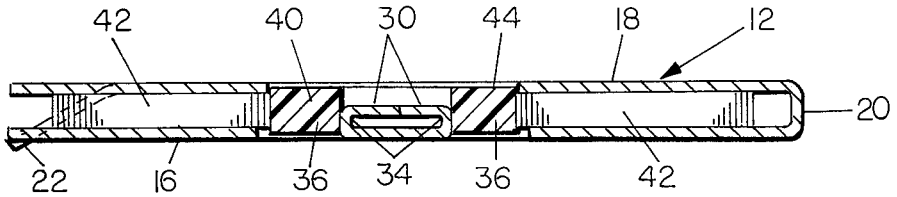
FIG. 4 is a sectional view of the package of FIG. 3 taken in the direction of arrows B—B in FIG. 3.

Folder panel 18 incorporates a pair of corner-locking tabs 22 which are formed by means of score lines 24 and slits 26. Folder panel 16 has removed portions of its corners, as illustrated by the numeral 28, so as to be adapted to receive the corner-locking tabs 22 on folder panel 18 to lock the respective panels in overlying relationship, as shown in FIG. 3. Folder panel 16 incorporates a pair of hub-locking tabs 30, which are formed by means of slit lines 32 and hingedly attached to the panel 16 along hinge panels 34. When folded about hinge panels 34, the hub-locking tabs 30 abut each other and assume the circular configuration shown in FIGS. 3 and 4. A pair of arcuate regions 36 adjacent to the area 38 which underlines the overlapping, folded hub-locking tabs 30, is crushed to a reduced thickness to accommodate a reel hub 40, about which a length of magnetic tape 42 is wound. As can be seen in FIG. 4, the reel hub 40 has a greater thickness than the tape 42. The folder panel 18 incorporates a large center cut-out area 44, which is sized to fit over the outside diameter of the reel hub 40.

Figure 5:
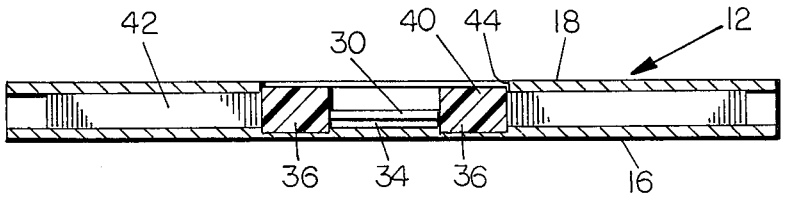
FIG. 5 is a sectional view taken in the direction of arrows A—A in FIG. 3.
Figure 7:
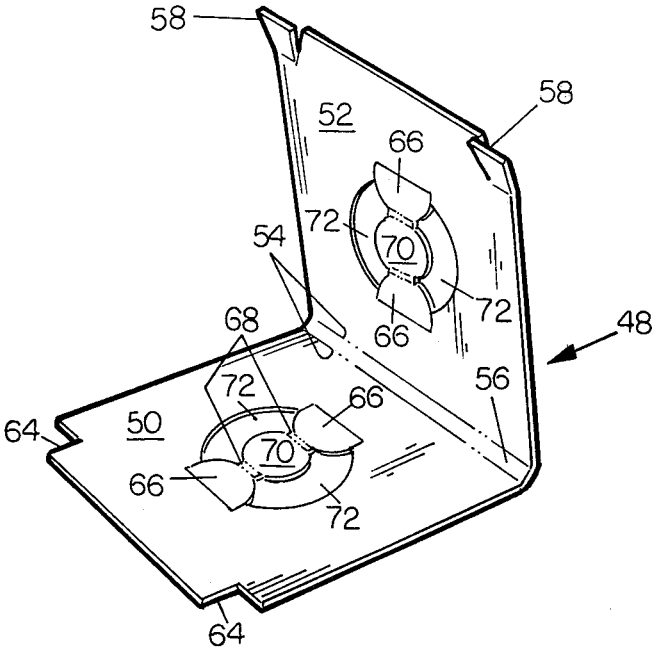
FIG. 7 is a perspective view of the paperboard sheet of FIG. 6 which has been folded to a position where it is adapted to receive a reel of magnetic tape.

Thus, it can be seen that, when it is desired to use the folder 12 to package a reel of tape, the hub-locking tabs 30 are folded into abutting relationship, and the center hub 40 is positioned thereon, so as to fit within the crushed area 36 of the folder panel 16. The other folder panel 18 may then be folded into overlying relationship with the panel 16, and the tape 42 on hub 40, so that the cutout 44 fits over the outside diameter of the hub 40. Thus, it can be seen in FIGS. 4 and 5 that the folder 12 of this invention rigidly holds the reel hub 40 so as to prevent it from movement relative to the folder 12. In addition, the overlapping side folder panels 16 and 18 are positioned in tight contact with the tape 42 which is wound about hub 40, thereby preventing the tape 42 from side slipping out of its tightly wound position. Corner-locking tabs 22 are then folded into corner cutouts 28, so as to lock under folder panel 16 to thereby hold the respective folder panels in contact with both sides of the tape 42 and complete the folder 12.

Figure 6:
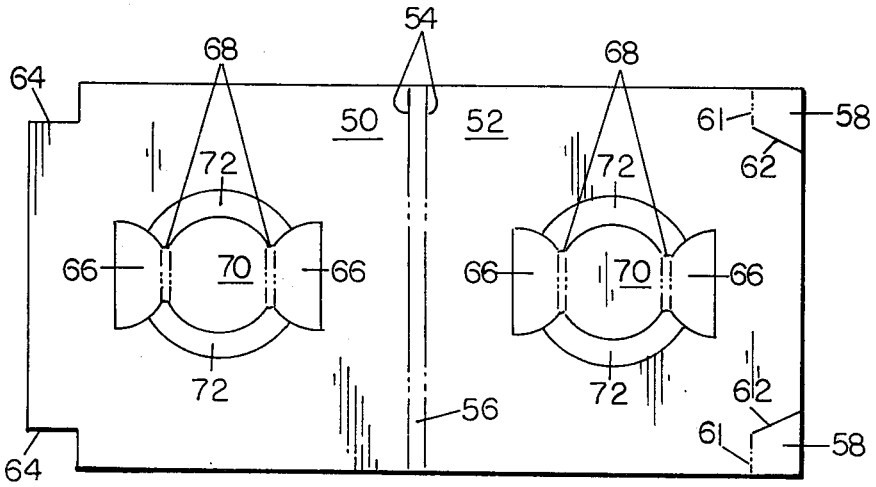
FIG. 6 is a top plan view of corrugated paperboard which has been slit and scored so as to be adapted to form an alternate embodiment of the folder package of this invention.
Figure 8:
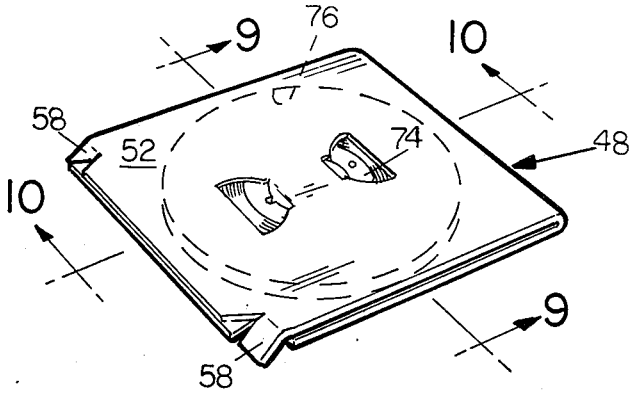
FIG. 8 is a perspective view of the folder of FIG. 7 after it has been folded to a closed position around a reel of tape.
Figure 9:
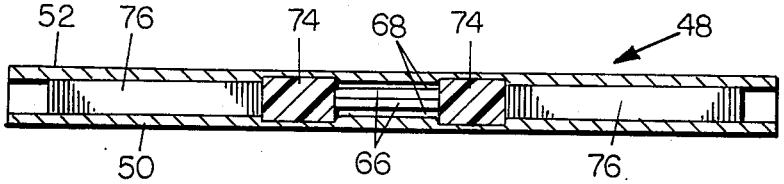
FIG. 9 is a sectional view of the folder of FIG. 8 taken in the direction of arrows A—A in FIG. 8.
Figure 10:
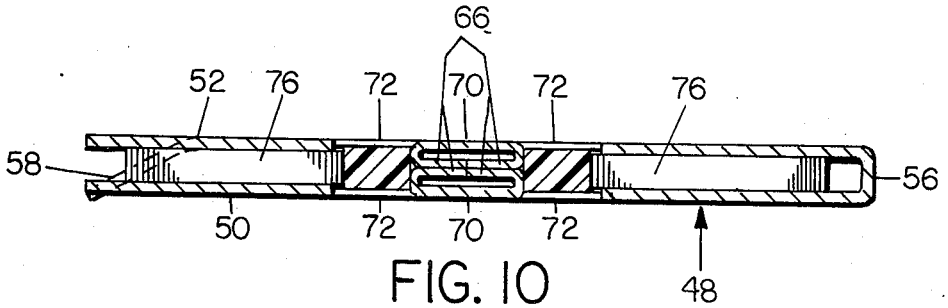
FIG. 10 is a sectional view taken in the direction of arrows B—B in FIG. 8.

FIGS. 6 through 10 provide an alternate embodiment of the folder package disclosed in FIGS. 1 through 5. FIG. 6 illustrates a sheet of corrugated paperboard 46, which has been slit and scored so as to be adapted to form the overlapping package folder 48 of FIG. 7. The folder 48 incorporates a pair of overlapping folder panels 50 and 52, which are formed by means of score lines 54 and hingedly attached to each other along a hinge panel 56 formed between the score lines 54. As was the case with the previous embodiment, folder panel 52 incorporates a pair of corner-locking tabs 58, which are formed by means of score lines 60 and slits 62 and are adapted to fit within corner cutouts 64 on folder panel 50. Each of folder panels 50 and 52 include a pair of hub-locking tabs 66, which are hingedly attached to their respective panels by means of hinge panels 68. The hub-locking panels 66 are adapted to be folded into abutting relationship to form a circular locking member overlying an area designated by the numeral 70. Each of the folder panels 50 and 52 include a pair of arcuate regions 72 adjacent to the areas 70, which have been crushed to a reduced thickness to accommodate a reel hub 74, about which a length of tape 76 has been wound. In this enbodiment, the hub-locking tabs 66 on each of the folder panels 50 and 52 are adapted to be folded to fit within the inside diameter of the reel hub 74, as can be seen in FIG. 10. These hub-locking tabs then securely position the center reel hub 74 and prevent it from sliding relative to the folder 48. Because of the crushed areas 72 in each of the folder panels, the folder panels fit tightly against the tape 76 when folded into overlapping relationship to thereby prevent sliding of the tape out of its tightly wound position about the center reel hub 74.

Thus, it can be seen from the preceding description that each of the embodiments of this invention provide a relatively simple folder package for securely packaging a reel of tape for shipping. Each of the embodiments of this invention overcomes the disadvantages associated with prior shipping packages for reels of tape be securely positioning the reel and snugly contacting the tape on both sides thereof to prevent shifting or side slipping of the tape out of its tightly wound position. The unique folder of this invention provides a relatively inexpensive, yet successful, package for shipping a reel of tape, which prevents the possibility of damage to the tape or the quality of the recording thereon.

I claim:

1. A tape reel shipping folder for packaging a reel of tape, wherein the tape is tightly wound into an annular reel about an annular reel hub, the annular reel hub having a thickness greater than the thickness of the tape, said shipping folder comprising a pair of folder panels hingedly connected and adapted to be folded into overlying relationship with the reel of tape positioned therebetween, one of said folder panels including a pair of hub-locking tabs hingedly attached to said folder panel and foldable into underlying, surface-to-surface contact with said folder panel and into free edge-abutting relationship with each other to form a substantially circular locking member adapted to fit within and continuously contact a major portion of the circumference of a center opening in said annular reel hub to position said reel of tape between said folder panels and a reduced thickness region overlying said annular reel hub and being adjacent to said hub-locking tabs to accomodate the greater thickness of said annular reel hub and allow said folder panel to flushly contact and securely hold said tape wound on said annular reel hub, and folder locking means formed on said pair of folder panels and locking said folder panels into engagement around said reel of tape.

2. A reel shipping folder as set forth in claim 1 wherein the other of said pair of folder panels also includes a pair of hub-locking tabs hingedly attached to said other folder panel and foldable into underlying surface-to-surface contact with said other folder panel and into free edge-abutting relationship with each other to form another substantially circular locking member adapted to fit within and continuously contact a major portion of the circumference of the center opening in said annular reel hub to position said reel of tape between said folder panels and a reduced thickness region overlying said annular reel hub and being adjacent to said hub-locking tab to accomodate the greater thickness of said annular reel hub and allow said other folder panel to flushly contact and securely hold said tape wound on said annular reel hub.

* * * * *